United States Patent [19]

Sasaki

[11] Patent Number: 4,566,778

[45] Date of Patent: Jan. 28, 1986

[54] PRESSURE FIXING DEVICE

[75] Inventor: Yoshitaka Sasaki, Kumagaya, Japan

[73] Assignee: Hitachi Metals, Ltd., Japan

[21] Appl. No.: 485,510

[22] Filed: Apr. 15, 1983

[30] Foreign Application Priority Data

Apr. 20, 1982 [JP] Japan ..... 57-66128
Aug. 4, 1982 [JP] Japan ..... 57-135903

[51] Int. Cl.[4] ..... G03G 15/20
[52] U.S. Cl. ..... 355/3 FU; 219/216
[58] Field of Search ..... 355/3 FU, 14 FU; 219/216, 469; 432/60

[56] References Cited

U.S. PATENT DOCUMENTS

| | | | |
|---|---|---|---|
| 3,937,919 | 2/1976 | Clerx et al. | 219/469 X |
| 4,192,229 | 3/1980 | Tsunoi et al. | 219/469 X |
| 4,200,389 | 4/1980 | Matsui et al. | 355/3 FU |
| 4,378,152 | 3/1983 | Edwards et al. | 355/3 FU |

*Primary Examiner*—Fred L. Braun

*Attorney, Agent, or Firm*—Finnegan, Henderson, Farabow, Garrett & Dunner

[57] ABSTRACT

A pressure fixing device including at least a pair of fixing rolls maintained in pressing engagement with each other such that their axes cross each other at a small angle $\theta_1$ to allow a supporter supporting a toner image thereon to pass therebetween at a velocity $V_2$ higher than the peripheral velocity $V_1$ of the fixing rolls, and a guide member located anterior to the fixing rolls with respect to the direction of movement of the supporter and having a forward end located in spaced juxtaposed relation to peripheral surfaces of the fixing rolls. The peripheral velocity $V_1$ of the fixing rolls is set such that the ratio $V_1/V_2$ is above 0.95, and the guide member is arranged such that a gap between the forward end of the guide member and the fixing rolls is about 5–20 times greater than the thickness of the supporter before fixing of the toner image is effected at least in a central portion of the length of the fixing rolls. A line of contact between the fixing rolls is inclined at a small angle $\theta'$ with respect to a straight line perpendicular to the direction of movement of the supporter.

8 Claims, 6 Drawing Figures

PRESSURE FIXING DEVICE

BACKGROUND OF THE INVENTION (1) Field of the Invention

This invention relates to a pressure fixing device for effecting fixing of a toner image on a supporter only by application of pressure at the supporter as the supporter moves between a pair of fixing rolls.

(2) Description of the Prior Art

In electrophotographic copying apparatus of the dry type, printers, facsimile system, etc., a pressure fixing device is used, for example, for fixing a toner image formed on a supporter, such as paper, following developing or transfer-printing. Various types of pressure fixing device are available, but a device having a pair of rollers, such as the one shown in FIG. 4 of Japanese Utility Model Laid-Open No. 164261/81, or a device having three rolls, such as the one shown in Japanese Patent Publication No. 48315/80, is usually used.

In this type of pressure fixing device, means is usually provided for causing the axes of the pair of rolls to cross each other to compensate for a deflection that might occur between the rolls maintained in pressing engagement with each other and obtain an axially uniform distribution of pressure, as described in Japanese Patent Publication No. 6911/80 and Japanese Patent Laid-Open No. 4075/80.

In this type of pressure fixing device, it is essentially impossible to render totally uniform in an axial direction the pressure distribution between the fixing rolls and the surface coarseness of the rolls, and the line pressure between the fixing rolls is high (10–25 kg/cm$^2$), so that the sheets handled tend to develop wrinkles at a higher rate than in fixing devices of the hot roll type. Particularly when there is a high degree of variation in the amount of toner adhering to the supporter axially thereof, the sheet tends to develop wrinkles. In the event that the toner supporter is transfer-printing sheet, such as ordinary paper, the paper would be fed between the rolls in waved condition due to the moisture contained therein when the humidity is high, thereby causing the paper to wrinkle.

To avoid wrinkle formation in the paper, a proposal has been made, as disclosed in Japanese Patent Publication No. 6911/80 and Japanese Patent Publication No. 3943/82, for example, to set the peripheral velocity of the fixing rolls at a level lower than the velocity at which the paper is moved, to loosen the paper from its carrier before the paper is fed into the nip between the fixing rolls. However, pressure fixing devices of the prior art have the trouble that, because the paper is loosened greatly, an impact of high order is produced when the paper is bitten by the fixing rolls and the toner image tends to be disturbed by the force of impact. Moreover, when the leading end portion of a copy sheet is caused to be uniformly bitten by the pair of pressure applying rollers by keeping the paper guide in one plane and parallel to a line of contact between the pair of pressure applying rollers, as described in Japanese Patent Publication No. 3943/82, an impact of high magnitude is produced when the sheet is bitten by the rollers and the force of impact is particularly high if there is a variation in the amount of the toner adhering to the sheet widthwise thereof.

Other proposals have also been made to avoid wrinkle formation. For example, Japanese Utility Model Laid-Open No. 39063/82 discloses the use of a guide member of a shape in which the forward end edge projects nearer to the rolls in its central portion than in opposite sides. In Japanese Utility Model Laid-Open No. 60159/82, a paper guide is disclosed which is curved at its forward end to provide a downwardly inclined surface substantially corresponding in configuration to the peripheral surface of the upper roller. The proposals would suffer the disadvantage that the shape of the paper guide is complex and might not suit practical use.

SUMMARY OF THE INVENTION

Objects of the Invention

An object of this invention is to provide a pressure fixing device capable of minimizing the risk of wrinkle formation in sheets handled.

Another object is to provide a pressure fixing device capable of greatly reducing a force of impact that would be produced when a sheet is bitten by the rolls.

Statement of the Invention

The outstanding characteristics of the invention are that, in a pressure fixing device comprising at least a pair of fixing rolls maintained in pressing engagement with each other and arranged such that their axes cross each other at a small angle $\theta_1$, to allow a supporter supporting a toner image thereon to pass therebetween at a velocity $V_2$ higher than the peripheral velocity $V_1$ of the fixing rolls, and a guide member located anterior to the fixing rolls with respect to the direction of movement of the supporter and having a forward end located in spaced juxtaposed relation to the peripheral surfaces of the fixing rolls, the peripheral velocity $V_1$ of the fixing rolls is set such that the ratio $V_1/V_2$ is above 0.95, that the guide member is arranged such that a gap between the forward end of the guide member and the fixing rolls is about 5–20 times greater than the thickness of the supporter before fixing of the toner image is effected at least in a central portion of the length of the fixing rolls, and that a line of contact between the fixing rolls is inclined at a small angle $\theta'$ with respect to a straight line perpendicular to the direction of movement of the supporter.

DESCRIPTION OF THE PREFERRED EMBODIMENT

The invention will now be described by referring to the accompanying drawings.

Figure 1:
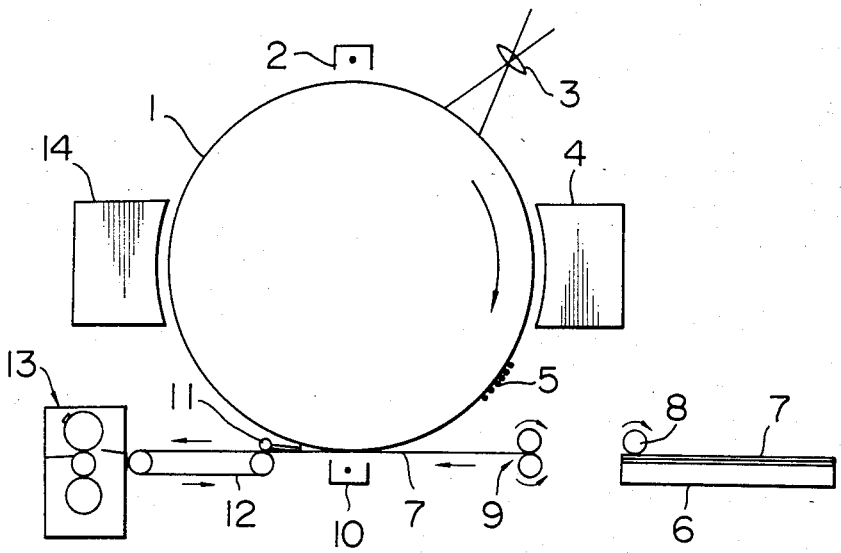
FIG. 1 is a schematic side view of one example of the electrophotographic copying apparatus of the transfer-printing type.
Figure 2:
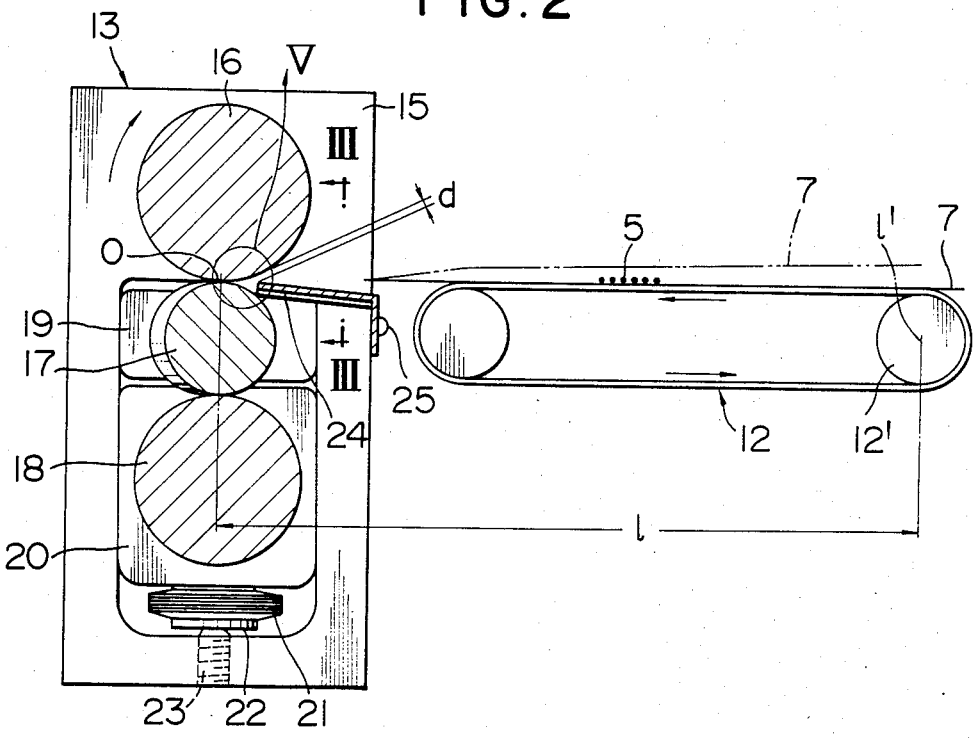
FIG. 2 is a sectional view of the pressure fixing device comprising one embodiment of the invention.
Figure 3:
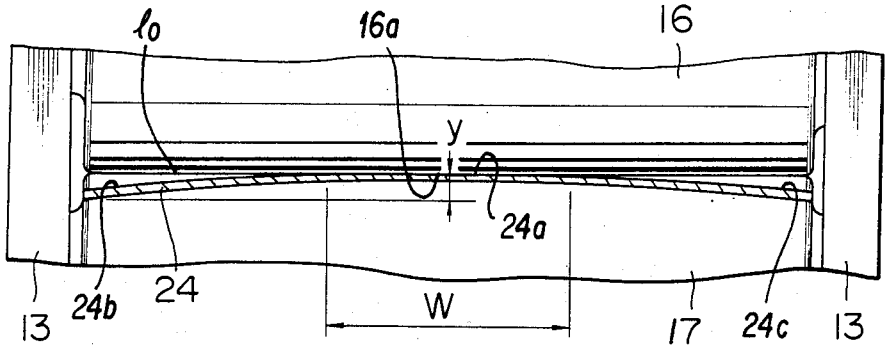
FIG. 3 is a view, on an enlarged scale, of the fixing rolls and the guide member as viewed in the direction of arrows III—III in FIG. 2.
Figure 4:
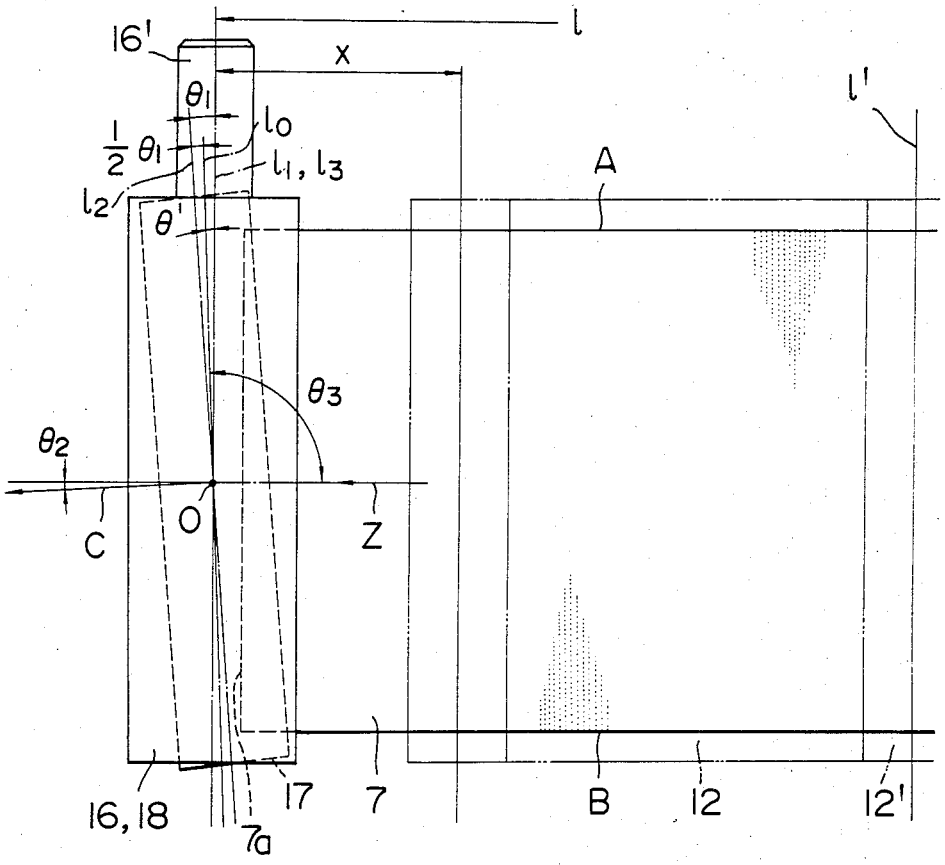
FIG. 4 is a plan view of the pressure fixing device shown in FIG. 2.
Figure 5:
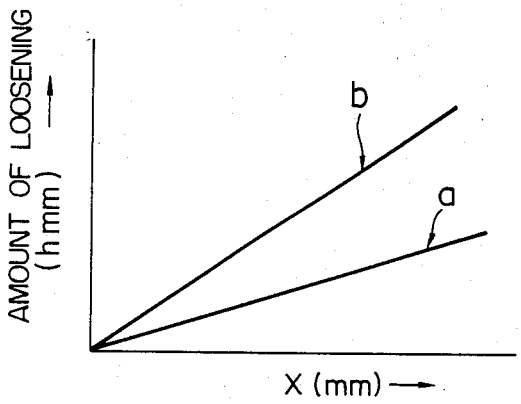
FIG. 5 is a diagrammatic representation of the amount of loosening of paper in relation to the distance between the line of contact between the rolls and the paper.
Figure 6:
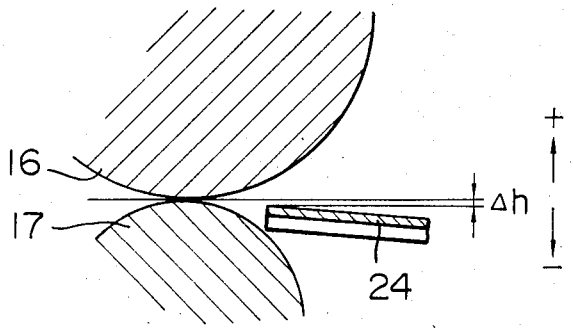
FIG. 6 is a view, on an enlarged scale, of the portion V shown in FIG. 2.

FIG. 1 is a schematic side view of one example of the electrophotographic copying apparatus of the transfer-printing type; FIG. 2 is a sectional view of the pressure fixing device comprising one embodiment of the invention; FIG. 3 is a view, on an enlarged scale, of the fixing rolls and the guide member as viewed in the direction of arrows III—III in FIG. 2; FIG. 4 is a plan view of the pressure fixing device shown in FIG. 2; FIG. 5 is a diagrammatic representation of the amount of loosening of the paper in relation to the distance between the line of contact between the rolls and the paper; and FIG. 6 is a view, on an enlarged scale, of the portion V shown in FIG. 2.

Referring to FIG. 1, the numeral 1 designates an image support drum (hereinafter simply drum) rotating in the direction of an arrow shown in the figure which is formed, on its peripheral surface, with a layer of a photosensitive member, not shown, such as Se, ZnO, etc. A peripheral surface of the drum 1 is first electrically charged in its entirety by a corona charger 2 and then exposed to an optical image of a document, for example, by an optical system 3, to form an electrostatic latent image, not shown, thereon. The electrostatic latent image is developed by a developing device 4 into a toner image 5 formed on the peripheral surface of the drum 1. The developing device 4 may be in the form of a magnetic brush type developer as described in Japanese Patent Laid-Open No. 138767/80. When the rotating drum 1 brings the toner image 5 to a transfer-printing position, a transfer-printing sheet 7 is fed from a sheet feeding tray 6 by sheet feeding rollers 8 and transported by a pair of conveyor rollers 9, in a direction to be superposed on the toner image 5 on the peripheral surface of the drum 1. Then a transfer-printing electric field is impressed on the toner image 5 through the transfer-printing sheet 7 from a side surface thereof opposite the side surface in contact with the drum 1 by means of a corona transfer-printer 10, so as to print on the transfer-printing sheet 7 an image of the toner image 5 on the drum 1. The transfer-printing sheet 7 is separated from the peripheral surface of the drum 1 by means of a separating claw 11 after the transfer-printing and forwarded to a pressure fixing device 13 by means of a conveyor belt 12. Although not particularly shown, the corona transfer-printer 10, separating claw 11 and conveyor belt 12 can be moved as a unit with respect to the drum 1, so that they are located in a position lower than the position shown except when transfer-printing is performed. The residual toner on the peripheral surface of the drum 1 may be removed therefrom by a cleaning device 14 as described in Japanese Patent Laid-Open No. 64274/80, for example, after the transfer-printing is effected.

The construction of the pressure fixing device according to the invention will be described by referring to FIGS. 2–6. In FIGS. 2–6, parts similar to those shown in FIG. 1 are designated by like reference characters.

Referring to FIG. 2, a fixing roll 16 is rotatably, journaled by bearings, not shown, attached to side plates 15, and another fixing roll 17 is journaled by bearings, not shown, attached to guide plates 19 vertically movably supported inwardly of the side plates 15. A pressure applying roll 18 is also journaled by bearings, not shown, attached to guide plates 20 vertically movably supported inwardly of the side plates 15. A pan spring 21 and a washer 22 are mounted between each guide plate 20 and the assocated side wall 15, and a pressure applying bolt 23 threadably connected to the side plate 15 is positioned against the bottom surface of the washer 22. By suitably tightening the pressure applying bolt 23, it is possible to bring the two pressure fixing rolls 16 and 17 and the fixing roll 17 and pressure applying roll 18 into pressure engagement with each other and at the same time to adjust the force with which they press against each other. The rolls 16, 17 and 18 may be in the form of steel rolls each having a hard chromium plating on the peripheral surface.

Referring to FIG. 2 again, the numeral 24 designates a guide member for guiding the transfer-printing sheet (which is paper in this embodiment) 7 between the two fixing rolls 16 and 17. The guide member 24 is screwed to the side plates 15 as indicated at 25 in such a manner that a forward end of the guide member 24 is spaced apart from the peripheral surfaces of the fixing rolls 16 and 17 a predetermined distance d, and is curved widthwise, as shown in FIG. 3. The guide member 24 may be formed as of a thin sheet metal (of a thickness of about 1 mm).

Referring to FIG. 4, in the pressure fixing device of the aforesaid construction, the fixing rolls 16 and 17 are arranged relative to each other in such a manner that their axes $l_1$ and $l_2$ cross each other at a small angle $\theta_1$, and the pressure applying roll 18 is arranged such that its axis $l_3$ overlies the axis $l_1$ as seen in a plan view. Thus, a line of contact between the fixing rolls 16 and 17 is located on a straight line $l_o$ which is inclined by $\frac{1}{2}\theta_1$ with respect to the axis $l_1$, $l_3$ or $l_2$. As shown in FIG. 4, axes $l_1$, $l_3$ are each perpendicular to the direction Z of the movement of sheet 7. The line $l_0$ therefore is also inclined to the leading edge of sheet 7. That is, in the device shown in FIG. 4, a leading end 7*a* of the transfer-printing sheet 7 is not bitten by the fixing rolls 16 and 17 uniformly along its width, but a B side of the leading end 7*a* is first bitten. In this pressure fixing device, the fixing roller 16 is driven at its end 16′ from a drive source, such as a motor, not shown, for rotation.

Let the peripheral velocities of the fixing rolls 16 and 17 be denoted by $V_1$ and the velocity of the conveyor belt 12 be denoted by $V_2$. In accordance with present invention, $V_1$ and $V_2$ are set to have a relation such that $V_1 < V_2$ and the value of $V_1/V_2$ is above 0.95. The $V_2$ is usually set at the same value as the peripheral velocity of the drum 1. The distance l between the conveyor belt 12 (the center axis l′ of a pulley 12′) and a crossing point 0 of the rolls 16 and 17 is generally set at a value smaller than that of the length of the transfer-printing sheet 7.

Operation of the pressure fixing device 13 of the aforesaid construction will now be described. After being separated from the peripheral surface of the drum 1 by the separating claw 11, the transfer-printing sheet 7 is conveyed by the conveyor belt 12 in the direction of an arrow Z in FIG. 2. In ordinary copying apparatus, the separating claw 11 is located only at one side of the drum 1 (at side A in this embodiment), so that the transfer-printing sheet 7 is conveyed on the conveyor belt in such a manner that the B side marginal portion shown in a broken line in FIG. 2 is separated from the surface of the belt 12. After the leading end of the transfer-printing sheet 7 has reached the guide member 24, however, the transfer-printing sheet 7 is transported along the surface of the guide member 24 and fed between the two fixing rolls 16 and 17.

As the leading end of the transfer-printing sheet 7 is bitten by the rolls 16 and 17, no restraining force is exerted on the trailing end of the transfer-printing sheet 7 because of the aforesaid numerical limitations $V_1 < V_2$ and $V_1 \geqq 0.95V_2$, so that wrinkle formation in the sheet 7 can be avoided.

Assume that $V_1$ is below $0.95V_2$ even if $V_1 < V_2$. Then the sheet 7 would be loosened more than is necessary and a force of impact of a high magnitude would be applied to the sheet 7 when it is bitten by the rolls 16 and 17, causing the toner on the sheet 7 to scatter and the toner image to be disturbed. However, if the numerical limitations are $V_1 < V_2$ and $V_1 \geqq 0.95V_2$ as described hereinabove, then the impact caused by the loosening of the sheet 7 can be minimized and the sheet 7 can be fed between the rolls 16 and 17 while moving substantially along the surface of the guide member 24, so that the force of impact which might be applied to the sheet 7 when it is bitten by the rolls 16 and 17 could be absorbed by the leading end thereof. This is conducive to prevention of scattering of the toner and the disturbance to the toner image. Particularly, it is preferred that the values of $V_1$ and $V_2$ be nearly equal to each other. More specifically, if they are set such that $V_1 \geqq 0.98V_2$, the sheet 7 has been found to be fed into the nip between the rolls 16 and 17 after moving substantially along the surface of the guide member 24, with a result that the impact produced when the sheet 7 is bitten by the rolls 16 and 17 is absorbed by the leading end of the sheet 7 and the disturbance of the toner image is essentially avoided because no scattering of the toner takes place.

The amount h of loosening of the sheet 7 which is proportional to the distance X from the crossing point 0 of the rolls 16 and 17 to the sheet 7 and inversely proportional to the value of $V_1/V_2$ is represented by straight lines as shown in FIG. 5. In FIG. 5, the value of $V_1/V_2$ is greater when the loosening is indicated by a straight line b than when it is indicated by a straight line a.

In the pressure fixing device 13 of the aforesaid construction, the line of contact between the rolls 16 and 17 is inclined, as shown in FIG. 4, by a small angle $\theta'$ ($=\frac{1}{2}\theta$) with respect to the leading end of the sheet 7, so that the leading end of the sheet 7 is not uniformly bitten by the rolls 16 and 17 and one side (on the side B) is first bitten. Thus the impact applied to the sheet when it is bitten by the rolls 16 and 17 is absorbed by one side of the leading end thereof, thereby enabling scattering of the toner to be minimized. This allows an image of high quality to be obtained without any disturbance to the toner image. A suitable value may be selected for the angle $\theta'$ depending on the quality of the sheet 7, the thickness thereof and the velocity at which the sheet 7 is conveyed. If the value is too large, wrinkles may be formed; if it is too small, no effects would be achieved by the forming of the angle $\theta'$. Thus the value of the angle $\theta'$ is preferably above about $1/10\theta_1$ and substantially below $\theta_1$.

The small angle $\theta'$ described hereinabove can be adjusted by tilting one end of the fixing device 13 toward the conveyor belt 12. For example, in FIG. 4, when the angle $\theta_1$ is 1°08′, the angle $\theta'$ becomes 9′ if a drive end (A) of the fixing device 13 is tilted toward the conveyor belt 12 by 0°25′ while keeping a driven end (B) stationary.

Referring to FIG. 4 again, let the angle formed by the direction of movement (indicated by the arrow Z) of the transfer-printing sheet 7 before transfer-printing is performed and the direction of movement (indicated by an arrow C) thereof after transfer-printing is performed and the angle of incidence of the transfer-printing sheet 7 with respect to the line of contact $l_o$ between the rolls 16 and 17 be denoted by $\theta_2$ and $\theta_3$ respectively. Then, $\theta_2 = \theta_3 - (90° - \frac{1}{2}\theta_1)$. In this case, when the length of the sheet 7 is denoted by L, the difference between $V_2$ and $V_1$ or ($V_2 - V_1 = \Delta V$) is preferably set as shown by the following equation (1):

$$\Delta V24\ (L-l) \times \tan\theta_2 \qquad (1)$$

If the sheet 7 (paper) is bitten by the rolls, the paper would be pulled. To avoid the paper being loosened more than is desirable and becoming wrinkled, the value of $\Delta V$ is set as aforesaid. However, if the value of $\Delta V$ is too great, the paper would become too loosened. Thus the value of $\theta_2$ is preferably set in the range between 05′ and 1°20′, or more preferably in the range between 10° and 1°00′. If $\Delta V > (L-l) \times \tan\theta_2$ in equation (1), loosening of the paper on the B side would become greater and the sheet 7 would not be bitten by the rolls 16 and 17 while moving along the surface of the sheet guide 24. Thus the value of $\Delta V$ would be optimized when set as $\Delta V = (L-l) \times \tan\theta_2$. For example, when paper of B4 size (Japanese Industrial Standard) of L=420 mm is used as the transfer-printing sheet 7 and the values of 1, $\theta_1$ and $\theta_2$ are set at 150 mm, 1°08′ and 91°, respectively, $(L-l) \times \tan\theta_2 = 20$ mm.

Thus one only has to set the value of $V_1$ as $V_1 \leqq 98.0$ mm/sec when $V_2$ is 100 mm/sec, and as $V_1$ 198.0 mm/sec when $V_2$ is 200 mm/sec, for example. This gives the value of $V_1/V_2$ as 0.98 and 0.99 when the $V_1 = 98.0$ mm/sec and $V_1 = 198.0$ mm/sec respectively.

The gap d between the peripheral surface of the fixing roll 16 and the forward end of the guide member 24 is set at a value greater than a thickness t of the transfer-printing sheet 7 to avoid jamming of the sheet 7. The transfer-printing sheet 7 is not necessarily conveyed singly and four or five transfer-printing sheets 7 may be conveyed in superposed relation. Thus it would be necessary to adjust the value of d in such a manner that it is greater than 5*t*. The transfer-printing sheet 7 may vary in thickness depending on the type of paper, and its thickness is generally between 60 and 100 μm. Thus the value of d would advantageously be over about 0.5 mm. If the value of d is too great, the sheet 7 would fail to be accurately bitten by the rolls 16 and 17, so that the gap d is preferably below 20 times greater than the thickness t of the sheet 7. More preferably, the value of the gap d is below about 1.2 mm. It is not necessary to adjust the gap d so that the value thereof will be in the aforesaid range through the entire length of the guide member 24. By adjusting the gap d for a length W corresponding to its central portion (or about 100 mm when the length of the guide member 24 corresponds to the width of B4 size paper) as shown in FIG. 3, the guide member will smoothly convey and feed the sheet 7 into the nip between the rolls 16 and 17.

The guide member 24 is slightly convexed in cross section with respect to roll 16, as shown in FIG. 3. Thus, guide member surface portions 24*b*, 24*c* that are transversely distant central surface portion 16*a* of fixing roll 16 are positioned below the line of contact $l_o$ of the fixing rolls 16, 17, in the apparatus orientation shown in FIG. 3. By virtue of this configuration, the transfer-printing sheet 7 conveyed along the surface of the guide member 24 tends to be pulled to opposite sides thereof, thereby enabling wrinkle formation in the sheet 7 to be avoided. However, if the maximum amount of buckling y of the guide member 24 is too great, conveying of the transfer-printing sheet 7 would be interfered with. Thus the value of y is preferably below 1.0 mm, or more preferably below 0.7 mm.

FIG. 6 shows the forward end of the guide member 24 in relation to the fixing rolls 16 and 17 in position. To avoid wrinkle formation in the transfer-printing sheet 7, central surface portion 24*a* of the forward end of the guide member 24 is advantageously located in a position at the same level as or slightly below the line of contact between the two rolls 16 and 17.

EXAMPLE

In the pressure fixing device 13 shown in FIG. 2, steel rolls of 34 mm in outer diameter and 270 mm in length were used as the rolls 16 and 18; a steel roll of 22 mm in outer diameter and 270 mm in length was used as the roll 17; the line pressure between the rolls 16 and 17 was adjusted to 20 kg/cm; and the cross angle $\theta_1$ of the roll 17 was set at 1°08′ and the small angle $\theta'$ thereof was adjusted to 12′. The pressure fixing device 13 of the aforesaid construction was built into a commercially available copying apparatus (SC 120 made by Copier Co.), and image fixing tests were conducted under the following conditions. The rolls 16, 17 and 18 all had their peripheral surfaces plated with hard chromium.

As copying sheets, transfer-printing sheets of A4 and B4 type paper having a thickness of 80 μm and treated to render their surfaces highly resistant were used. Three types of images were formed on these sheets: type (a) having a white color on the entire surface, type (b) having a black color on the entire surface and type (c) having a chart of Japan Electronics Society. These three types of images were fixed under the two different environmental conditions: 23° C. and 68% R.H. and 26° C. and 80% R.H.

The vertical distance Δh between the forward end of the guide member 24 and the line of contact between the rolls 16 and 17 (see FIG. 6) was adjusted into the following three types: (a) +1.75 mm (central portions) and +1.65 mm (opposite end portions), (b) −0.10 mm (central portion) and −0.20 mm (opposite end portions) and (c) −1.0 mm (central portion) and −1.1 mm (opposite end portions).

Tests were conducted on 200 sheets for each type of image under the aforesaid conditions to determine the incidence of wrinkle formation in each type. The results of the rests are shown in Table 1 and based on the number of wrinkles including not only those which are recognizable with the naked eye on the image surface but also those small ones which are barely discernible from under the image surface.

TABLE 1

| | | Incidence of Wrinkle Formation (%) | | | | | | | |
|---|---|---|---|---|---|---|---|---|---|
| Environmental Conditions | | 23° C.; 68% R.H. | | | | 26° C.; 80% R.H. | | | |
| | Sheet | Image | | | | | | | |
| Δh | size | (a) | (b) | (c) | Mean | (a) | (b) | (c) | Mean |
| (a) | A4 | 1 | 0 | 0 | 0.3 | 31 | 32 | 0.5 | 21.2 |
| | B4 | 5 | 2 | 3 | 3.3 | 100 | 100 | 100 | 100 |
| | Mean | | | | | 31.2 | | | |
| (b) | A4 | 0 | 0 | 0 | 0 | 1 | 30 | 1 | 10.7 |
| | B4 | 0 | 0 | 0 | 0 | 27 | 22 | 92 | 47 |
| | Mean | | | | | 14.4 | | | |
| (c) | A4 | 0 | 1 | 0 | 0.3 | 0 | 28 | 1 | 9.7 |
| | B4 | 0 | 0 | 0 | 0 | 19 | 11 | 98 | 42.7 |

TABLE 1-continued

| | | Incidence of Wrinkle Formation (%) | | | | | | | |
|---|---|---|---|---|---|---|---|---|---|
| Environmental Conditions | | 23° C.; 68% R.H. | | | | 26° C.; 80% R.H. | | | |
| | Sheet | Image | | | | | | | |
| Δh | size | (a) | (b) | (c) | Mean | (a) | (b) | (c) | Mean |
| | Mean | | | | | 13.2 | | | |

Remarks:
The wrinkles formed at 23° C. and 68% R.H. are all tiny ones, and the wrinkles formed at 26° C. and 80% R.H. are all those which are recognizable on the image surface.

From the results of the tests shown in Table 1, it will be appreciated that the incidence of wrinkle formation in the copy sheets is lower when the forward end of the guide member 24 is located vertically below the line of contact between the rolls 16 and 17 than when it is located above the line of contact between them. Particularly when fixing of the images is performed under enviromental condition of high temperature it is possible to reduce the incidence of wrinkle formation by positioning the forward end of the guide member below the line of contact between the fixing rolls.

Effects Achieved

As described hereinabove, the pressure fixing device according to the invention is constructed such that an image supporter is not only fed into the nip between the fixing rolls in loosened condition, but also the image supporter has no tensile force acting thereon when bitten by the fixing rolls. When the image supporter is bitten by the fixing rolls, the force of impact applied thereto can be leasened. Thus the invention enables a fixed image of high quality to be obtained without scattering of the toner and formation of wrinkles.

Applications

In the embodiment shown and described hereinabove, the pressure fixing device according to the invention has been described as being provided with three rolls. It is to be understood, however, that the invention is not limited to the specific number of rolls of the device and that the invention can have application in a pressure fixing device having two rolls. Also, the invention can be incorporated not only in a copying apparatus of the so-called PPC system which includes a transfer-printing device but also in a copying apparatus of what is generally referred to as a CPC system in which an image is fixed immediately after being developed.

What is claimed is:

1. In a pressure fixing device having at least a pair of fixing rolls each having peripheral velocity $V_1$ and maintained in a pressing engagement with each other such that their axes cross each other at a small angle $\theta_1$ to allow a supporter supporting a toner image thereon to move in a direction therebetween at a velocity $V_2$, one of the fixing rolls contacting and fixing the toner image on the supporter during movement of the supporter between the rolls; and a guide member located anterior to the fixing rolls with respect to the direction of movement of the supporter and having a forward end located in spaced juxtaposed relation to peripheral surfaces of the fixing rolls;

wherein the improvement comprises that:

the peripheral velocity $V_1$ of the fixing rolls is set such that $V_2 \geqq V_1$ and the ratio $V_1/V_2$ is above about 0.95;

A guide member is arranged such that a gap between the forward end of the guide member and the surface of that one of the fixing rolls disposed to contact the toner image is of a dimension about 5–20 times greater than the thickness of the supporter before fixing of the toner image is effected, said gap dimension occurring at least at a central portion of the length of the fixing rolls; and a line of contact between the fixing rolls is inclined at a small angle $\theta'$ with respect to a straight line perpendicular to the direction of movement of the supporter.

2. The pressure fixing device as claimed in claim 1, wherein the peripheral velocity $V_1$ of the fixing rolls is set such that the ratio $V_1/V_2$ is above about 0.98.

3. The pressure fixing device as claimed in claim 2, wherein the value of $\theta'$ is above about 1/10 $\theta_1$ and substantially below $\theta_1$.

4. The pressure fixing device as claimed in claim 1, further including said guide means having a supporter-contacting surface curved in a direction transverse to the direction of movement of the supporter, said curvature being convex as viewed from said one fixing roll.

5. The pressure fixing device as claimed in claim 4 wherein the curvature of said guide member surface results in a central surface portion displacement of less than about 1 mm relative to the outer surface portions.

6. The pressure fixing device as claimed in claim 1, further including said guide means having a supporter-contacting surface curved in a direction transverse to the direction of movement of the supporter, said curvature being convex with respect to said one fixing roll, and wherein at least the portions of said guide member surface transversely distant the central fixing roll portion are located in positions below the position of the line of contact between the fixing rolls.

7. The pressure fixing device as claimed in claim 6 wherein all portions of said guide member surface are below the contact line position.

8. The pressure fixing device as claimed in claim 1, wherein the forward end of said guide member is located in a position at or below the position of the line of contact between the fixing rolls.

* * * * *